United States Patent [19]

Chambley et al.

[11] 4,120,143

[45] Oct. 17, 1978

[54] FLUID SELF-TWIST SPINNING APPARATUS

[75] Inventors: Phillip W. Chambley; Alan H. Norris, both of Rome, Ga.

[73] Assignee: Champion International Corporation, Stamford, Conn.

[21] Appl. No.: 845,340

[22] Filed: Oct. 25, 1977

[51] Int. Cl.[2] ..... H01B 13/04

[52] U.S. Cl. ..... 57/34 AT; 57/34 B

[58] Field of Search ..... 57/34 AT, 34 B, 157 F

[56] References Cited

U.S. PATENT DOCUMENTS

| | | | |
|---|---|---|---|
| 2,983,026 | 5/1961 | Skalko | 57/34 B |
| 3,007,298 | 11/1961 | Williams et al. | 57/34 B |
| 3,443,370 | 5/1969 | Walls | 57/34 AT |
| 3,474,613 | 10/1969 | Joarder et al. | 57/34 B |
| 3,775,955 | 12/1973 | Shah | 57/34 AT |
| 4,003,195 | 1/1977 | Fernstrom et al. | 57/34 AT X |
| 4,055,039 | 10/1977 | Movshovich et al. | 57/34 AT |

*Primary Examiner*—Charles Gorenstein
*Attorney, Agent, or Firm*—Evelyn M. Sommer

[57] ABSTRACT

A stable plied yarn is produced by false-twisting two or more singles yarn strands with jets and passing the strands around a yarn wheel whereon the nodes are joined. The strands leave the wheel and ply together. The plied yarn passes through a reversible jet aspirator which assists the plying and propels the yarn through a coiled tube. The aspirator is supplied with air or with steam to bulk the yarn. After leaving the tube, the yarn can be caused to strike a solid surface to further enhance bulking. A press roll at the yarn wheel aids in defining a twist trap.

7 Claims, 9 Drawing Figures

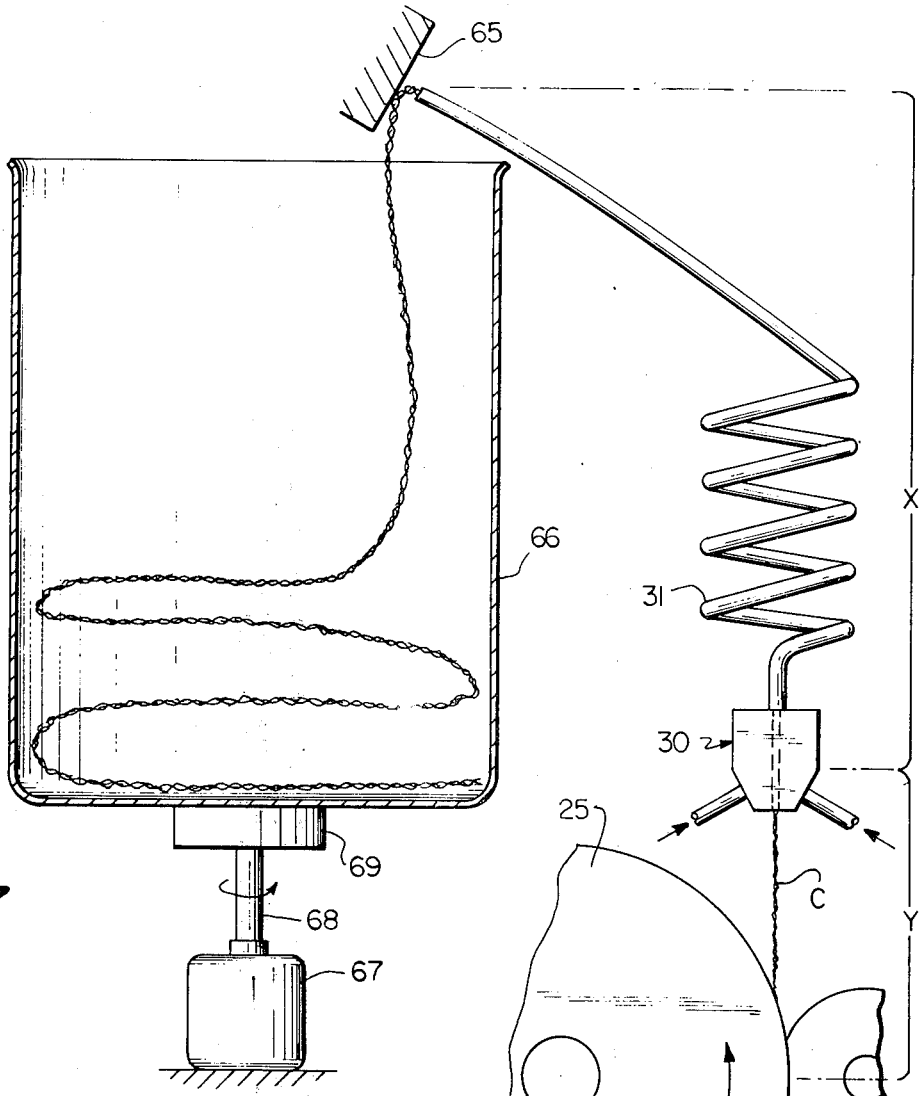
FIG. 7
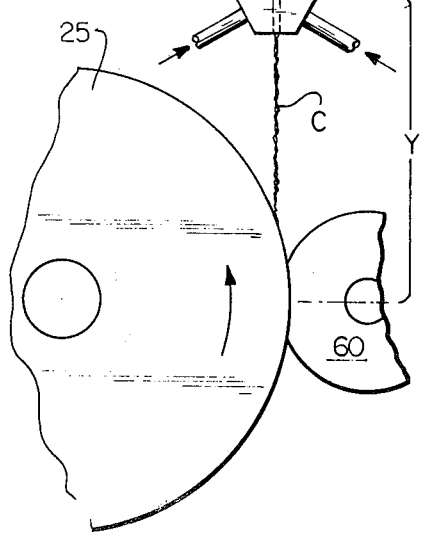
FIG. 8
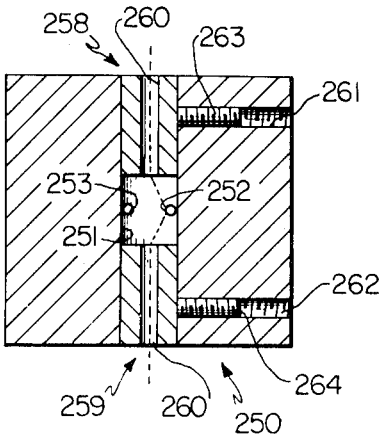
FIG. 9
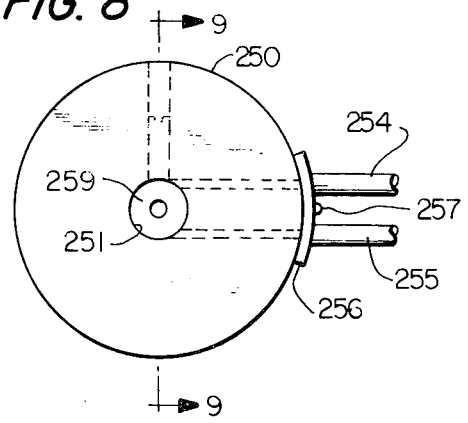

FLUID SELF-TWIST SPINNING APPARATUS

BACKGROUND OF THE INVENTION

The concept of producing plied yarns using the false-twist, self-twist phenomenon are now rather well known in the art. Documents in which the general principles of false-twisting and self-twisting are described include the following:

"Self-Twist Yarn," D. E. Henshaw, Merrow Publishing Co., Ltd., Watford, Herts, England, 1971; U.S. Pat. Nos.:

RE 27,717, Breen et al;
3,225,533 Henshaw;
3,306,023, Henshaw et al;
3,353,344, Clendening, Jr.;
3,434,275, Backer et al;
3,507,108, Yoshimura et al;
3,717,988, Walls;
3,775,955, Shah;
3,940,917, Strachan.

For purposes of convenience, some general comments concerning producing plied yarn by these techniques will be described. It is possible to form a plied yarn by false-twisting two or more singles yarn strands, attaching the strands to each other and then permitting the strands to wrap about each other using the release of forces stored by the false-twisting to accomplishing the plying, hence the term "self-twist." The false-twisting itself, in simplified form, involves holding spaced points of a yarn strand and twisting the strand in one direction at a point intermediate the held points, e.g., the center. This produces twists on one side of the center in one direction and on the other side of the center in the opposite direction. The center of the twisted strand constitutes a point of twist reversal and is called a "node." Clearly, forces are stored in the strand in the twisting step. When two strands similarly false-twisted are brought together in side-by-side juxtaposition and permitted to act against or with each other by releasing the nodes, the stored forces cause the strands to ply, i.e., to wrap around each other spontaneously. The process is enhanced and the product made more stable if the nodes of the two strands are aligned and are joined or locked together before release and plying.

As will be recognized, the torque or twist force exerted by each strand is roughly proportional to the amount of twist therein and that such force decreases as the strands ply. The plying step itself therefore continues until the stored twist forces in each strand decrease to a point at which the remaining twist forces are exactly counterbalanced by the resistance to further twisting in the plied yarn. Thus, if one begins with individual strands and then false twists the strands and plies them, each strand will end up, in the plied yarn, with some degree of false-twist which can be thought of as some remaining stored potential energy, the force exerted thereby being too small to cause further ply twisting against opposing frictional forces in the plied yarn.

An apparatus for false-twisting and node fastening and plying singles yarn strands is fully described in U.S. Pat. Ser. No. 755,671, filed Dec. 30, 1976 now U.S. Pat. No. 4,074,511, wherein a rotatable guide member receives the false-twisted yarn and fastens the nodes thereof using a rotating contact device carried by the guide member.

While the apparatus is quite satisfactory, it has been found desirable to assist the self-twist plying process and also to add bulk to the yarn in a practical continuous process for producing plied yarn.

BRIEF DESCRIPTION OF THE INVENTION

Briefly described, the invention includes in an apparatus for forming a plied self-twisted yarn from at least two singles yarn strands of the type comprising means for false-twisting each of the yarn strands, and guide means for conveying said yarn strands away from said false-twisting means and for locking the nodes of said yarn strands to each other while maintaining the false-twist therein, the improvement comprising fluid jet means downstream of said guide means for promoting the plying of said strands, said fluid jet means being spaced from said guide means to define a plying region therebetween. A press wheel can be provided adjacent said guide means to aid in defining a twist trap in said plying region.

Said fluid jet means can employ heated fluid such as steam to promote the plying and concurrently bulk the yarn.

In order that the manner in which the various objects are attained in accordance with the invention can be understood in detail, advantageous embodiments thereof will be described with reference to the accompanying drawings, which form a part of this specification, and wherein:

FIG. 7 is a side elevation schematically illustrating a further embodiment of the invention;

FIG. 8 is a plan view of a false-twist jet usable in the apparatus of FIGS. 1 and 4; and FIG. 9 is a side elevation, in section, along line 9—9 of FIG. 8.

DETAILED DESCRIPTION OF THE INVENTION

Figure 1:
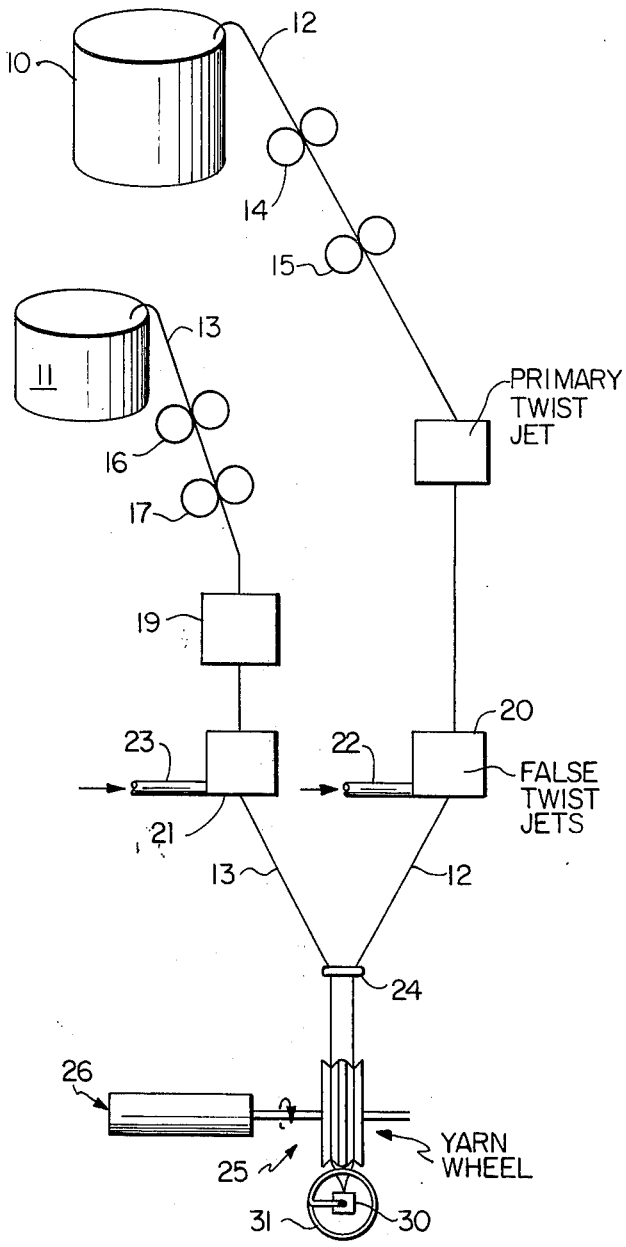
FIG. 1 is a schematic diagram of a system for forming self-twisted yarn employing apparatus according to the present invention.

As shown in FIG. 1, a system with which the invention can be employed can include the apparatus for forming and initially false-twisting the strands. The system commences with the yarn strands being withdrawn from sliver containers 10 and 11, the yarn strands 12 and 13 being subjected to a drafting or drawing process by pulling the yarns between drafting rolls, yarn 12 being drawn by drafting rolls 14 and 15 and yarn 13 being drawn by rolls 16 and 17. Roll 15 is typically driven at a surface velocity greater than that of roll 14 and roll 17 is driven at a surface velocity greater than roll 16. The yarns can then be passed through primary twist jets, yarn 12 being passed through jet 18 and yarn 13 being drawn through jet 19. The primary twist jets operate to impart and maintain twist at the critical point where the otherwise flat sliver ribbon leaves the draft delivery rolls. Yarn strand 12 is then passed through a singles-twist jet 20 and yarn 13 is then passed through a singles-twist jet 21 wherein the false-twist is inserted in the yarn strands. Air pressure under the control of apparatus not shown is supplied to jets 20 and 21 through conduits 22 and 23, respectively.

The control apparatus for the air supplied to jets 20 and 21 may be fluidic valves, electrical valves or mechanically operated valves, such apparatus being conventionally available. An example thereof is to be found at page 30 of the previously cited Henshaw text, "Self-Twist Yarn," in FIG. 3.8(*b*). It should be noted at this stage that jets 20 and 21 are paired to twist the yarn strands in the same direction as each other and are operated to periodically reverse the direction of twist to result in producing a yarn wherein there are opposite senses of twist separated by short nodes of zero twist, which nodes are in synchronization with the yarn wheel which bears a fixation device so that the nodes appear at the surface of the fixation disc at the appropriate time. Thus, yarn strands 12 and 13 emerge from jets 20 and 21 with alternating S and Z portions of twist therein.

The strands are then passed through a wire guide which can constitute a single elongated wire guide 24, or which can include separate wire guides associated with jets 20 and 21. The wire guide in either form assists in maintaining the singles twist in the yarn strands and serves the purpose of bringing the yarn into a relatively closely spaced relationship, preferably not in contact with each other. The yarns are guided onto a yarn wheel indicated generally at 24, the details of which will be described hereinafter. Yarn wheel 25 serves the function of guiding the yarns in parallel spaced relationship with each other, fixing the yarns at their nodes by means of a rotating fixation device, along with appropriate guides.

After the yarn has been twisted and locked on yarn wheel 25, the yarn is delivered to an aspirator twist jet 30, which is shown only schematically in FIG. 1, and which will be described in greater detail. The yarn then passes through a helical tube 31, after which it is stored or further bulked and stored, as will be described.

Figure 2:
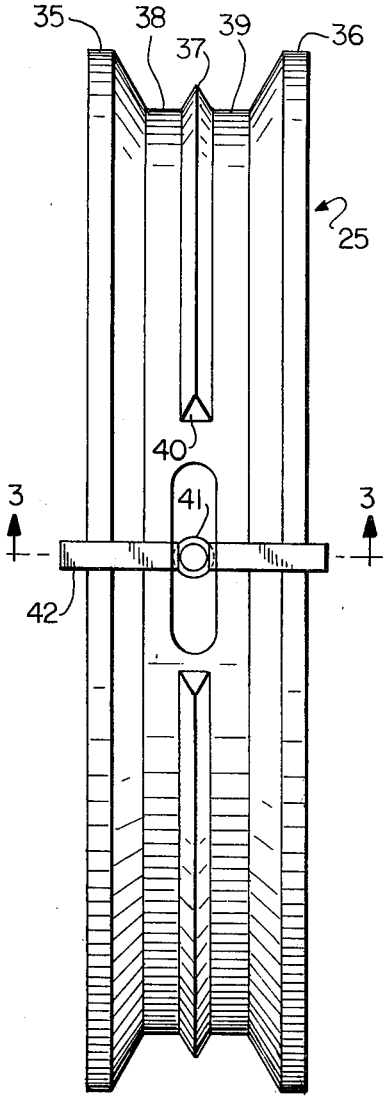
FIG. 2 is a front elevation of a yarn wheel usable in the apparatus of FIG. 1.
Figure 3:
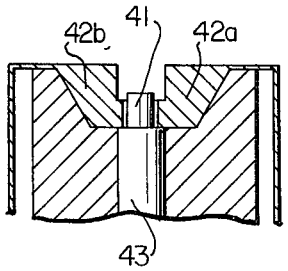
FIG. 3 is a sectional view along lines 3—3 of FIG. 2.

It will be recognized that the portion of the apparatus of FIG. 1 up to and including yarn wheel 25 is disclosed and more fully described in the aforementioned U.S. Pat. No. 4,074,511. A yarn wheel, which is also shown in that application, and which is usable in the apparatus of FIG. 1, is illustrated in FIGS. 2 and 3 and includes a generally disc-shaped member having flanges 35 and 36 at the axial limits thereof and a central, separatory flange 37, the three flanges defining peripheral surface portions 38 and 39 along which yarn strands can be separately guided. Although wheel 25 is shown as having a single central, separatory flange 37, additional separatory flanges may be provided depending upon the number of singles yarns being plied. The number of separatory flanges will always be one less than the numbers of singles yarns being plied. Central flange 37 is interrupted at 40 to permit the strands to come into close proximity with each other and also to come in contact with the contacting surface of the fixation device which, in the illustrated embodiment, is an abrasion disc 41 which is rotated about an axis generally perpendicular to the axis of rotation of the yarn wheel and at a relatively high speed, on the order of 8,000 rpm. Typically, the disc can be driven by an electric motor which is mounted in the yarn wheel and to which DC voltage is supplied by means of a brush and slip ring combination, not shown. Regardless of the number of separatory flanges 37 utilized, each singles yarn must be brought into contact with other singles yarn on the disc 41 by suitable channeling means, one embodiment of which is illustrated at 42 in FIG. 2.

As further shown in FIG. 3, the channeling means can include guide portions 42*a* and 42*b* which serve to deposit the yarn directly on the surface of the fixation disc 41 and also serve to maintain the yarn on the disc long enough to fix the nodes. The disc can be driven by an electrical motor having an output shaft 43. Although FIG. 2 illustrated a wheel 25 having a single rotation means 41, such wheel can be provided with a plurality of such fixation means distributed around the wheel, it being understood that each such fixation means should be positioned to contact a node.

Figure 4:
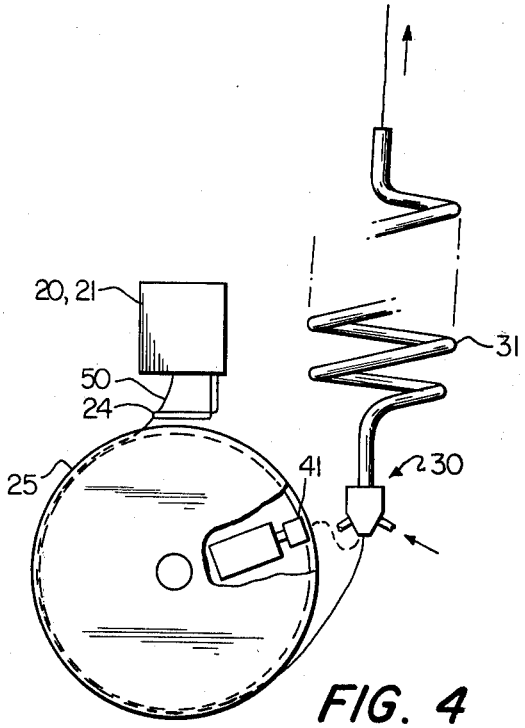
FIG. 4 is a schematic side elevation of the yarn wheel, aspirator twist jet and tube portion of the apparatus of FIG. 1 in accordance with the invention.

FIG. 4 illustrates, in schematic form, that portion of the apparatus beginning with false-twist jets 20 and 21 from which false-twisted yarn strands, indicated in FIG. 4 as a strand 50, leave the false-twist jets and pass through a wire guide 24 onto the guide surfaces of yarn wheel 25. The nodes of the strands are synchronized with wheel rotation so that they encounter fixation device 41 and are locked, the strands then passing into an opening at the lower end of aspirator twist jet 30. As the singles strands leave the yarn wheel, they immediately begin to ply together, forming the self-twisted yarn. The aspirator twist jet assists the plying process by air tangentially supplied to a central passage therethrough in one of the two possible directions and the yarn then enters the lower end of helical tube 31. The self-twisted yarn then emerges from the upper end of tube 31, passage therethrough being assisted by air flowing from jet 30 through the tube.

It will be observed that the twist is largely concentrated in a relatively short length below the aspirator twist jet after departure from the yarn wheel and, hence, has a relatively high concentration of turns per inch and a high torque. Above the aspirator twist jet the turns in the plied yarn are in one direction and the aspirator twist jet is twisting the yarn in the opposite direction. Thus, if the twist in the plied yarn above jet 30 are Z turns, the jet at that time is twisting in the S direction, i.e., clockwise as viewed from above. It will also be the case that the turns about jet 30 will be equal in number to those below jet 30 after departure from the yarn wheel. The turns below the jet are limited by the torque applied in the aspirator and the length of the yarn extending between the center of the aspirator twist jet and the point of departure of the yarn wheel which constitutes a twist trap. That trap can, if desired, be enhanced and more clearly defined by placing a press roll in a position to contact the yarn on yarn wheel 25.

It is advantageous that the distance between the center of jet 30 and the twist trap point on the yarn wheel be as short as possible, as will be further described.

Figure 5:
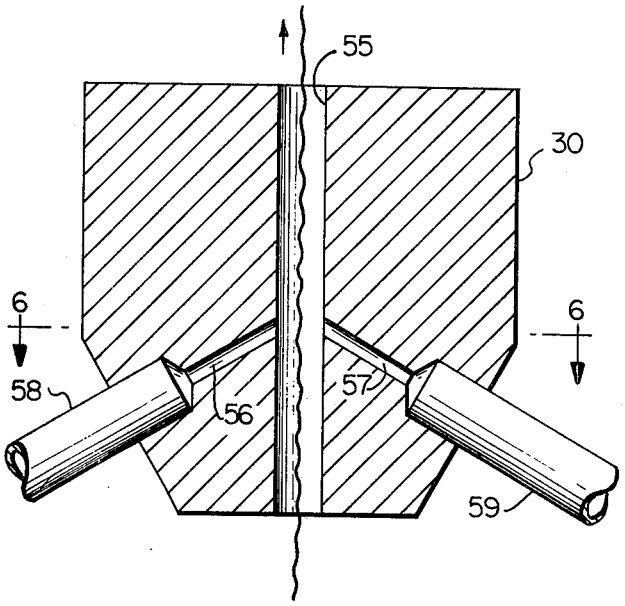
FIG. 5 is a side elevation, in section, of an aspirator twist jet in accordance with the invention.
Figure 6:
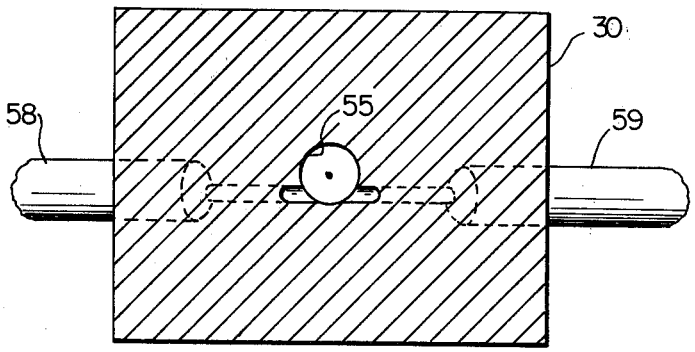
FIG. 6 is a plan view, in section, along line 6—6 of FIG. 5.

The aspirator twist jet is shown in greater detail in FIGS. 5 and 6, the jet comprising a body having a central bore 55 through which the yarn passes. Air supply bores 56 and 57 extend tangentially into bore 55 and lie in substantially the same vertical plane with each other, these air conduits being disposed so that their central axes intersect each other at an angle of somewhat less than 180°. As will be recognized from FIG. 6, air supplied through conduit 56 will cause counterclockwise flow of air in bore 55, while air supplied through conduit 57 will cause clockwise flow therein, as viewed from the top. Since these conduits slope upwardly, the flow of air will also be axially upwardly within bore 55, thereby propelling the yarn passing through bore 55 upwardly while also imparting twist thereto.

The outer portions of bores 56 and 57 are enlarged to receive air supply conduits 58 and 59, the other ends of which are connected to suitable air supply and valve means so that air can alternately be supplied to the two conduits. As will be recognized, the direction of twist, and therefore the supply of air to one of the two conduits, is alternated as a node passes their point of intersection with bore 55 to reverse the direction of twist. A short interval of no air flow can also be caused to exist to prevent twisting at the node itself.

A further embodiment of the invention is shown in FIG. 7 wherein a twist trap is defined between the nip consisting of wheel 25 and a press roll 60 and the point within jet 30 at which conduits 56 and 57 intersect bore 55. Press roll 60 is a freely rotatable roll having a surface configuration capable of contacting the yarn in the guide channels 38 and 39 of wheel 25. Additionally, the embodiment of FIG. 7 illustrates an additional bulking technique wherein the yarn emerging from the upper end of tube 31 is directed against a solid or foraminous surface 65 with considerable axial force so that the yarn is additionally bulked by the impact thereof. The yarn is then deposited into a container 66 after it falls away from surface 65, container 66 being continuously rotated by a motor 67 having an output shaft 68 which drives a support 69 on which container 66 rests. The purpose of the rotation is to distribute the yarn in a coiled fashion within the container. After placement in container 66, the bulked yarn can be then be autoclaved, if desired.

Certain characteristics and advantages of the system will now be described. First, it will be recognized that the inner diameter of the tube 31 should be selected such that the yarn can float rather freely in a fairly gentle airstream in the tube so that the yarn can accept twist therein and float upwardly. It will also be recognized that the central axis of the helix need not be vertical, but can be horizontal, if desired.

An additional advantage in this system can be gained if, instead of cool air, air at an elevated temperature or steam is supplied to conduits 58 and 59 supplying the aspirator twist jet. The temperature of the fluid medium supplied to jet 30 should be sufficiently high to elevate the yarn temperature above its glass transition temperature, a point which will be different for each polymer employed for making the yarn when that yarn is synthetic. By employing a heated fluid, the bulking of the yarn within tube 31 is considerably promoted. Thus, after tube bulking and impact bulking as illustrated in FIG. 7, the yarn is highly bulked by the time it is deposited in container 66.

It should also be noted that the plied yarn can be regarded as having two distinct sections during the processing as illustrated by the regions X and Y in FIG. 7, Y being defined between the twist point in jet 30 and the twist trap between wheel 25 and press roll 60, and section X being defined by the portion between the jet center and the next point at which the yarn is subjected to a mandatory direction change which, in the embodiment of FIG. 7, constitutes its point of impact with surface 65. The effectiveness of the device is greatly improved when the portion identified as section Y is a relatively small fraction of the section X length so that the twist imposed per unit length in region Y is much greater than twist imposed in region X.

While certain advantageous embodiments have been chosen to illustrate the invention, it will be understood by those skilled in the art that various changes and modifications can be made therein without departing from the scope of the invention as defined in the appended claims.

What is claimed is:

1. In combination with an apparatus for forming a plied self-twisted yarn from at least two singles yarn strands of the type comprising means for false-twisting each of the yarn strands and guide means for conveying said yarn strands away from said false-twisting means, the improvement comprising fluid jet means downstream of said guide means for promoting the plying of said strands, said fluid jet means including a source of fluid under pressure, a twist jet comprising a body having inlet means for selective connection to said source of fluid under pressure and a control yarn passage communicating with said inlet means, and an elongated coiled tube having an inlet end and an outlet end, the inlet end of said tube being connected to the outlet end of said passage to convey yarn away from said twist jet and being spaced from said guide means to define a plying region therebetween.

2. An apparatus according to claim 1 wherein said inlet means includes first and second conduits in said body tangentially intersecting said control yarn passage, said conduits having central axes lying in substantially the same plane, said axes intersecting each other at an angle of less than 180°, whereby fluid under pressure introduced through one of said circuits induces spiral fluid flow in each passage in one circular direction and fluid introduced through the other of said conduits induces spiral flow in the other circular direction.

3. An apparatus according to claim 1 wherein said guide means includes a rotatable yarn guide wheel having flange means defining substantially parallel guide paths around a portion of the wheel periphery; and fiber entanglement means carried by and rotatable with said guide wheel for contacting and locking together the nodes of said yarn strands.

4. An apparatus according to claim 3 and further comprising a rotatable press wheel in nip contact with said guide wheel for defining one end of a twist trap between the nip thereof and said twist jet.

5. An apparatus according to claim 4 wherein the distance between said nip and said twist jet is significantly shorter than the length of said coiled tube.

6. An apparatus according to claim 1 wherein said source of fluid under pressure supplied steam to said twist jet.

7. An apparatus according to claim 1 and further comprising means defining a solid surface disposed transversely to the axis of the outlet end of said tube and spaced therefrom in the path of axial movement of plied yarn emerging from said tube for contacting said yarn to enhance bulking thereof; and a yarn receptacle disposed generally beneath said surface to receive plied yarn after contact with said surface.

* * * * *